US008575853B2

(12) United States Patent
Peng

(10) Patent No.: US 8,575,853 B2
(45) Date of Patent: Nov. 5, 2013

(54) SYSTEM AND METHOD FOR SUPPLYING CONSTANT POWER TO LUMINUOUS LOADS

(75) Inventor: Chunghang Peng, Walnut, CA (US)

(73) Assignee: Ace Power International, Inc. (TW)

( * ) Notice: Subject to any disclaimer, the term of this patent is extended or adjusted under 35 U.S.C. 154(b) by 855 days.

(21) Appl. No.: 12/689,789

(22) Filed: Jan. 19, 2010

(65) Prior Publication Data

US 2011/0175532 A1 Jul. 21, 2011

(51) Int. Cl.
*H05B 37/02* (2006.01)

(52) U.S. Cl.
USPC ..... 315/291; 315/308

(58) Field of Classification Search
USPC ..... 315/200 R, 209 R, 224, 225, 276, 291, 315/307, 308
See application file for complete search history.

(56) References Cited

U.S. PATENT DOCUMENTS

| | | | | |
|---|---|---|---|---|
| 4,385,347 | A | 5/1983 | Takematsu | |
| 4,422,016 | A * | 12/1983 | Kurple | 315/241 S |
| 4,471,327 | A | 9/1984 | Moss | |
| 4,685,020 | A | 8/1987 | Driscoll | |
| 4,710,695 | A | 12/1987 | Yamada et al. | |
| 4,740,880 | A | 4/1988 | Peruth | |
| 4,812,959 | A | 3/1989 | Driscoll et al. | |
| 4,939,632 | A | 7/1990 | Plagge et al. | |
| 5,073,850 | A | 12/1991 | Pace | |
| 5,175,675 | A | 12/1992 | Uramoto | |
| 5,515,256 | A | 5/1996 | Yokoyama | |
| 5,699,237 | A | 12/1997 | Seragnoli | |
| 5,751,560 | A | 5/1998 | Yokoyama | |
| 5,850,335 | A | 12/1998 | Otake | |
| 5,852,549 | A | 12/1998 | Heeringa | |
| 6,445,598 | B1 | 9/2002 | Yamada | |
| 7,213,940 | B1 | 5/2007 | Van De et al. | |
| 7,333,353 | B2 | 2/2008 | Yin | |
| D570,537 | S | 6/2008 | Chan et al. | |
| D570,538 | S | 6/2008 | Chan et al. | |
| D570,539 | S | 6/2008 | Chan | |
| D571,497 | S | 6/2008 | Chan et al. | |
| D571,944 | S | 6/2008 | Pickard | |
| D573,294 | S | 7/2008 | Chan et al. | |
| D581,082 | S | 11/2008 | Chan | |
| D581,083 | S | 11/2008 | Chan | |
| D586,942 | S | 2/2009 | Chan et al. | |
| D592,348 | S | 5/2009 | Trott et al. | |
| D596,330 | S | 7/2009 | Pickard et al. | |
| 2007/0024213 | A1 * | 2/2007 | Shteynberg et al. | 315/291 |
| 2007/0171145 | A1 | 7/2007 | Coleman et al. | |
| 2007/0279440 | A1 | 12/2007 | Negley | |
| 2007/0290625 | A1 | 12/2007 | He et al. | |

(Continued)

*Primary Examiner* — Jimmy Vu
(74) *Attorney, Agent, or Firm* — Fountain Law Group, Inc.; George L. Fountain

(57) ABSTRACT

An apparatus is disclosed that is capable of delivering substantially constant power to a luminous load in response to variation in the input voltage and variation in the environment temperature. The apparatus may be further adapted to vary the power supplied to the luminous load in response to changes in the input voltage produced by a dimmer circuit. In other words, during non-dimming applications, the apparatus is able to maintain substantially constant power supplied to the load even though the input voltage and environment temperatures are varying during typical daily operations. Additionally, if the input voltage is changed due to a user controlling a dimmer device to control the brightness of the luminous load, the apparatus is able to control the power delivered to the load in response to the dimmer device.

21 Claims, 8 Drawing Sheets

(56) References Cited

U.S. PATENT DOCUMENTS

| | | | |
|---|---|---|---|
| 2008/0084700 | A1 | 4/2008 | Van De |
| 2008/0112168 | A1 | 5/2008 | Pickard et al. |
| 2008/0130298 | A1 | 6/2008 | Negley |
| 2008/0137347 | A1 | 6/2008 | Trott et al. |
| 2008/0278952 | A1 | 11/2008 | Trott et al. |
| 2008/0278957 | A1 | 11/2008 | Pickard et al. |
| 2008/0304269 | A1 | 12/2008 | Pickard et al. |
| 2010/0141173 | A1 * | 6/2010 | Negrete ..... 315/294 |

* cited by examiner

SYSTEM AND METHOD FOR SUPPLYING CONSTANT POWER TO LUMINUOUS LOADS

FIELD

This invention relates generally to supplying power to luminous loads, and in particular, to a system and method of supplying substantially constant power to a luminous load within a defined input voltage range and temperature range. Additionally, the system and method are capable of adequately interfacing a dimmer circuit to a luminous load, such that the illumination or brightness of the luminous load may be controlled by the dimmer.

BACKGROUND

Light fixtures that use light emitting diode (LED) technology for illumination are gaining in popularity. These fixtures are now employed more frequently in commercial, residential and public settings. The main reasons that LED-based light fixtures are becoming more popular are that they generally have a longer operational life and operate at a much higher power efficiency. For example, LED-based light fixtures typically have an operational life of around 50 to 100 thousand hours; whereas, incandescent-based light fixtures typically have an operational life of only one to two thousand hours. Additionally, LED-based light fixtures typically have a light efficacy that is 5 to 10 times that of an incandescent light fixture.

Driving or supplying power to LED-based light fixtures, however, may need more consideration to ensure substantially constant illumination. In the past, LED-based light fixtures have been driven by constant output voltage and constant output current ballasts. However, these devices generally do not provide constant power to LED-based loads, and thus, cannot ensure constant illumination of the luminous loads.

Taking, as an example, a constant output voltage ballast, it employs output voltage feedback to ensure that the voltage across an LED-based load is substantially constant. However, the junction voltage of LED devices decreases as environment temperature increases. As a consequence, the current, as well as the power, supplied to the LED load increases with a rise in temperature. As the current increases, this, in turn, may create more heat, which results in even higher current delivered to the load. This, in effect, may result in a thermal runaway, which may eventually lead to a burn out of the LED-based load.

In the case of a constant output current ballast, it employs output current feedback to ensure that the current through the LED-based load is substantially constant. However, as discussed above, the junction voltage of LED devices decreases as environment temperature increases. This has the consequence of the output voltage, as well as the power, decreasing with a rise in temperature. In this case, the LED light output will decrease with rising temperature, which may be undesirable for lots of applications.

Another issue with constant output voltage and current ballasts is that they do not work well with phase control dimming circuits. A phase control dimming circuit controls the amount of power delivered to a luminous load by suppressing or cutting off a portion of the rectified input voltage. Accordingly, as the dimmer is controlled to reduce the brightness of the luminous load, the constant output voltage or current ballast would sense the output voltage or current reduction due to the dimmer, and try to increase the same to maintain the same output voltage or current. As a result, the brightness of the luminous load remains fairly the same, even though the dimmer is attempting to reduce the brightness. This renders the dimmer ineffective.

SUMMARY

An aspect of the invention relates to an apparatus that is capable of delivering substantially constant power to a luminous load in response to variation in the input voltage and variation in the environment temperature. In another aspect, the apparatus is further adapted to vary the power supplied to the luminous load in response to changes in the input voltage produced by a dimmer circuit. In other words, during non-dimming applications, the apparatus is able to maintain substantially constant power supplied to the load even though the input voltage and environment temperatures are varying during typical daily operations. Additionally, if the input voltage is changed due to a user controlling a dimmer device to control the brightness of the luminous load, the apparatus is able to control the power delivered to the load in response to the dimmer device.

Other aspects, advantages and novel features of the present invention will become apparent from the following detailed description of the invention when considered in conjunction with the accompanying drawings.

DETAILED DESCRIPTION OF THE EXEMPLARY EMBODIMENTS

Figure 1:
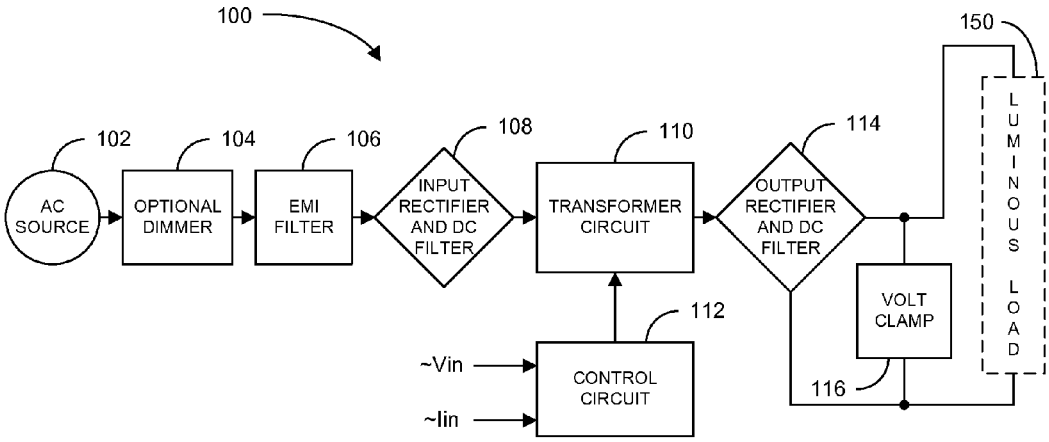
FIG. 1 illustrates a block diagram of an exemplary system for supplying substantially constant power to a luminous load in accordance with an embodiment of the invention.

FIG. 1 illustrates a block diagram of an exemplary system 100 for supplying substantially constant power to a luminous load 150 in accordance with an embodiment of the invention. The system 100 may be an example of a lighting system for a residential, commercial or government application. The system 100 comprises a utility alternating current (ac) source 102 (e.g., 60 Hz, 110-120 Volt line, 50 Hz, 220-240 Volt line, etc.), an optional dimmer 104 (e.g., a phase control dimmer circuit), an electromagnetic interference (EMI) filter 106, an input rectifier and direct current (dc) filter 108, a transformer circuit 110, a control circuit 112, an output rectifier and DC filter 114, and a voltage clamp 116. As discussed above, the system 100 supplies substantially constant power to a luminous load 150, which could be an LED-based, incandescent-based, fluorescent-based, or other type of luminous load.

The AC source 102 supplies power in the form of an alternating voltage (ac) (e.g., a substantially sinusoidal voltage) having defined or standardized parameters, such as the North American standard of 60 Hz, 110-120 Volt or the European standard of 50 Hz, 220-240 Volt. The optional dimmer may be a phase-control type dimmer circuit, which suppresses or cut-outs a portion of the ac voltage based on a user input device (e.g., a dimming knob) for the purpose of controlling the illumination or brightness of the luminous load 150. The EMI filter 106 reduces extraneous signal interference and noise that may be present on the ac voltage line. The input rectifier and DC filter 108 rectifies the ac voltage of the EMI filter 106 in order to generate an input voltage for the transformer circuit 110.

The control circuit 112 controls or modulates the current through the transformer circuit 110 in response to a voltage ~Vin that is derived from the input voltage to the transformer circuit 110, and a current ~Iin that is derived from a current flowing through the input winding of the transformer circuit 110. The control circuit 112 is adapted to control the current through the input winding of the transformer circuit 110 in order to control, regulate, or maintain the power delivered to the luminous load 150. The control circuit 112 may employ pulse width modulation at a substantially constant frequency to regulate the power delivered to the luminous load 150. More specifically, the control circuit 112 is adapted to maintain the power delivered to the luminous load 150 substantially constant given a defined range for the input voltage to the transformer circuit 110 and a defined temperature range. Additionally, as discussed in more detail below, the control circuit 112 may be, at least partially, insensitive to the dimmer control, allowing the dimmer to control the brightness of the luminous load 150 without compensating for the reduced power delivered to the load.

The output rectifier and DC filter 114 rectifies and DC filters the voltage developed across or partially across an output winding of the transformer circuit 110 in order to generate a regulated output voltage and current for the luminous load 150. Alternatively, as discussed in more detail below, the output rectifier and DC filter 114 may perform its rectifying and filtering operations based on the voltage across or partially across an input winding of the transformer circuit 110. The voltage clamp 116 protects the luminous load from voltages that may spike or surge above a defined threshold level. The voltage clamp 116 performs this by shunting the load when the output voltage exceeds the defined threshold.

Figure 2:
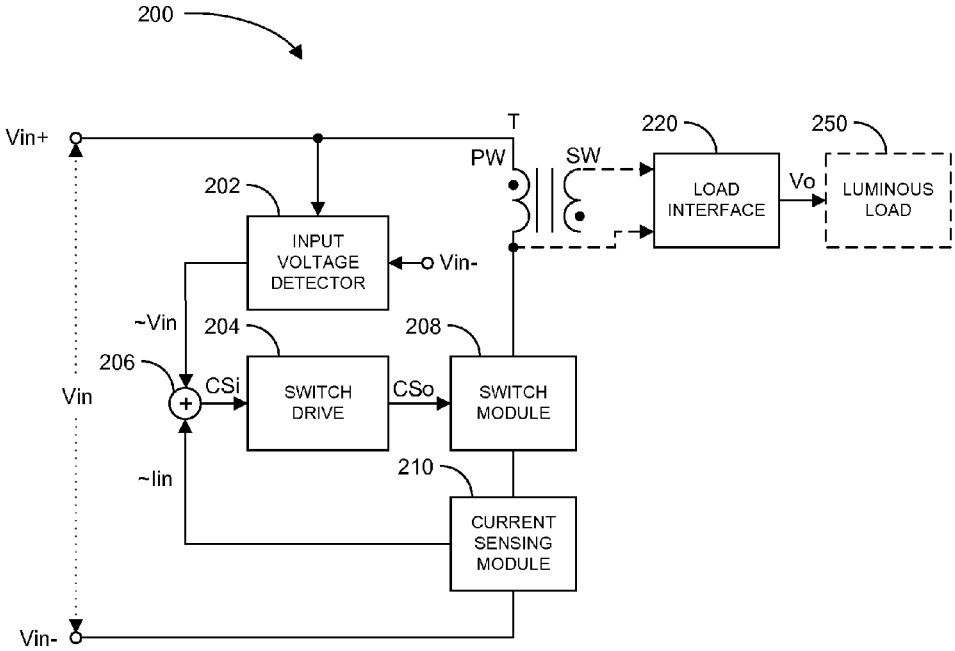
FIG. 2 illustrates a block diagram of an exemplary apparatus for supplying substantially constant power to a luminous load in accordance with another embodiment of the invention.

FIG. 2 illustrates a block diagram of an exemplary apparatus 200 for supplying substantially constant power to a luminous load 250 in accordance with an embodiment of the invention. The apparatus 200 comprises an input voltage detector 202, a switch drive 204, a summing node 206, a switch module 208, a current sensing module 210, a transformer T including a primary winding (PW) and a secondary winding (SW), and a load interface 220. The input voltage detector 202 generates a signal ~Vin that is derived from or related to an input voltage Vin. The current sensing module 210 generates a signal ~Iin that is derived from or related to a current flowing through the primary winding (PW) of the transformer T. The summing mode 206 combines or sums the two signals ~Vin and ~Iin to generate an input signal CSi for the switch drive 204.

The switch drive 204 develops a control signal CSo for driving (e.g., turning ON and OFF) the switch module 208 based on the input signal CSi. As an example, the control signal CSo may be a pulse-width modulated signal cycling substantially at a center operating frequency, and modulated based on the input signal CSi. As previously discussed, the switch drive 204 may generate the control signal CSo in order to regulate the power delivered to the luminous load 250. For instance, the control signal CSo may be set or adjusted to maintain the power delivered to the luminous load 150 substantially constant for a defined range of the input voltage Vin and/or the environment temperature. Additionally, the switch drive 204 may generate the control signal CSo such that it is at least partially insensitive to the dimmer control, allowing the dimmer to control the brightness of the luminous load 150 without compensating for the reduced power delivered to the load. The load interface 220 conditions (e.g., rectifies, filters, etc.) the voltage across or partially across the input winding (PW) or output winding SW of the transformer T to generate an output voltage Vo for the luminous load 250. The load interface 220 may further provide over-voltage protection of the luminous load 250.

Figure 3A:
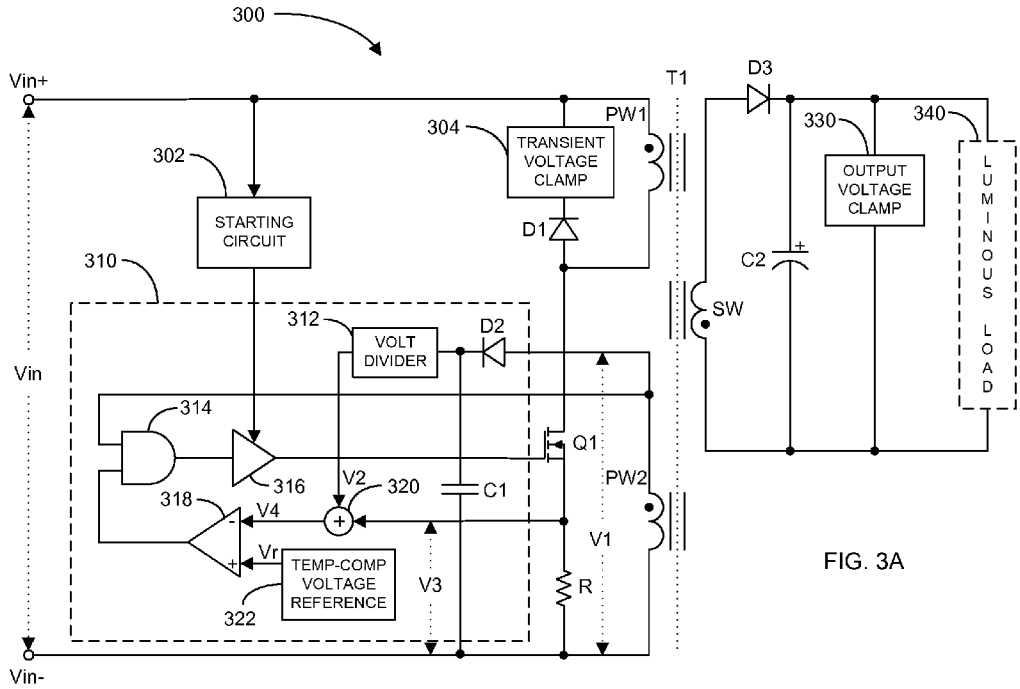
FIGS. 3A-3B respectively illustrate schematic diagrams of other exemplary apparatuses for supplying substantially constant power to a luminous load in accordance with other embodiments of the invention.

FIG. 3A illustrates a schematic diagram of another exemplary apparatus 300 for supplying substantially constant power to a luminous load 340 in accordance with another embodiment of the invention. The apparatus 300 comprises a starting circuit 302, a transient voltage clamp 304, a first diode D1, a control circuit 310, a metal oxide semiconductor field effect transistor (MOSFET) Q1, a current-sensing resistor R, a transformer T1 including coupled windings, such as first and second primary windings PW1-2 and secondary winding SW2, a third diode D3, a second capacitor C2, and an output voltage clamp 330. The control circuit 310, in turn, comprises a voltage divider 312, a second diode D2, first capacitor C1, an AND-gate 314, a driver 316, a voltage summing node 320, a temperature-compensated voltage reference 322, and a voltage comparator 318.

The starting circuit 302 is adapted to generate a starting current in response to detecting the input voltage Vin so that the driver 316 generates a signal adapted to turn ON the MOSFET Q1. This produces a current to flow from the positive input voltage terminal Vin+ through the first primary winding PW1 of the transformer T1, MOSFET Q1, and current-sensing resistor R, and to the negative input voltage terminal Vin−. This causes energy to be stored in the primary winding PW1 of the transformer T1. In response to the transformer current, a voltage V3 develops across the current-sensing resistor R that is related (e.g., proportional) to the transformer current. Additionally, a voltage V1 develops across the second primary winding PW2 of the transformer T1 that is related or derived from the input voltage Vin by the equation, V1=Vin×N, where N is the turn ratio between the first primary winding PW1 and the second primary winding PW2. Through the diode D2, the voltage V1 is stored by the capacitor C1, and then scaled by the voltage divider 312 in order to generate a voltage V2. At the summing node 320, the voltages V2 and V3 are combined to generate a voltage V4, which may be related to the power delivered to the luminous load 340 for a defined range of the input voltage Vin.

The voltage V4 is applied to the negative input of the comparator 318, and a reference voltage Vr generated by the temperature-compensated voltage reference 322 is applied to the positive input of the comparator. Initially or upon start-up, the output of the comparator 318 is at a high logic level due to the voltage V4 being lower than the reference voltage Vr. Due to the rising transformer current V3 and the transformer voltage V2, the voltage V4 rises above the reference voltage Vr. When this occurs, the comparator 318 then generates a low logic level. As a consequence, the AND-gate 314 produces a low logic level, which the driver 316 outputs to cause the MOSFET Q1 to turn OFF. When this occurs, the windings of the transformer T1 reverse its voltage polarity (commonly referred to as a fly-back action).

During this time, the energy stored in the first primary winding PW1 of the transformer T1 is released to the luminous load 340 by way of the secondary winding SW of the transformer. Once all of the energy in the primary winding PW1 of the transformer T1 is released, the voltages on windings PW1-2 and S2 reverse again, and allow the MOSFET Q1 to turn ON again. This process continuously repeats causing the MOSFET Q1 to turn ON and OFF, and sustain its self oscillation at a particular or defined frequency. The duty cycle or pulse width of the signal driving the MOSFET Q1 is modulated by the voltage V2 which is related or derived from the input voltage Vin, and the voltage V3 which is related or derived from the current through the primary winding of the transformer T1. The duty cycle and frequency of the signal driving the MOSFET Q1 adjust for each cycle in order to maintain substantially a constant power delivered to the luminous load 340 even in view of fluctuations in the input voltage Vin and the environment temperature. By configuring the voltages V2 and V3, the control circuit 310 is capable of delivering substantially constant power to the luminous load 340 within a specific or defined voltage range of the input voltage Vin. The use of the temperature-compensated voltage reference 322 provides the temperature-compensation to maintain the load power substantially constant in view of temperature variation.

The third diode D3, second capacitor C2 and output voltage clamp 330, in this example, make up the load interface circuit. More specifically, the third diode D3 rectifies the alternating energy released from the transformer T1, and the second capacitor C2 dc filters the rectified energy to generate the output voltage across the luminous load 340. The duty cycle and frequency of the signal driving the MOSFET Q1 as well as the transformer T1 may be configured to provide a relatively high ac power factor (e.g., >80%) in delivering power to the luminous load 340. The control circuit 310 may be configured easily into an integrated circuit form, discrete circuit form, or a combination thereof.

In any non-normal operating condition that causes the output voltage across the luminous load 340 to exceed a defined level, the output voltage clamp will activate and automatically shunt the output voltage and reduce the power delivered to the load in order to prevent damage to the load and the apparatus 300. Additionally, the transient voltage clamp 304 is coupled in series with the first diode D1 to clamp leakage energy from the first primary winding PW1 of the transformer T1 to prevent excessive voltage present to the MOSFET Q1 when it is turned OFF. This clamp circuit 304 may contain transient voltage suppressor or other resistor, capacitor or combination thereof to achieve the voltage clamping function.

The control circuit 310 may also be configured to be insensitive to adjustment of the input voltage Vin due to it being controlled by a phase control dimmer circuit. As previously discussed, a phase control dimmer circuit suppresses or cuts-out a portion of the input rectified waveform Vin. If the portion of the input rectified waveform being suppressed is less than a half period or 180 degrees of the waveform, the peak of the input waveform is not affected. However, the received power or integration of the rectified waveform varies as a function of the waveform suppression. If the voltage V2 is configured to vary only as a function of the peak voltage of the input rectified voltage Vin, then the dimmer circuit is able to reduce the power delivered to the luminous load without the control circuit 310 reacting to the reduced power. Thus, the apparatus 300 is able to adequately interface a dimmer circuit to the luminous load 340, and at the same time maintain constant power to the load during normal or non-dimming operations.

Figure 3B:
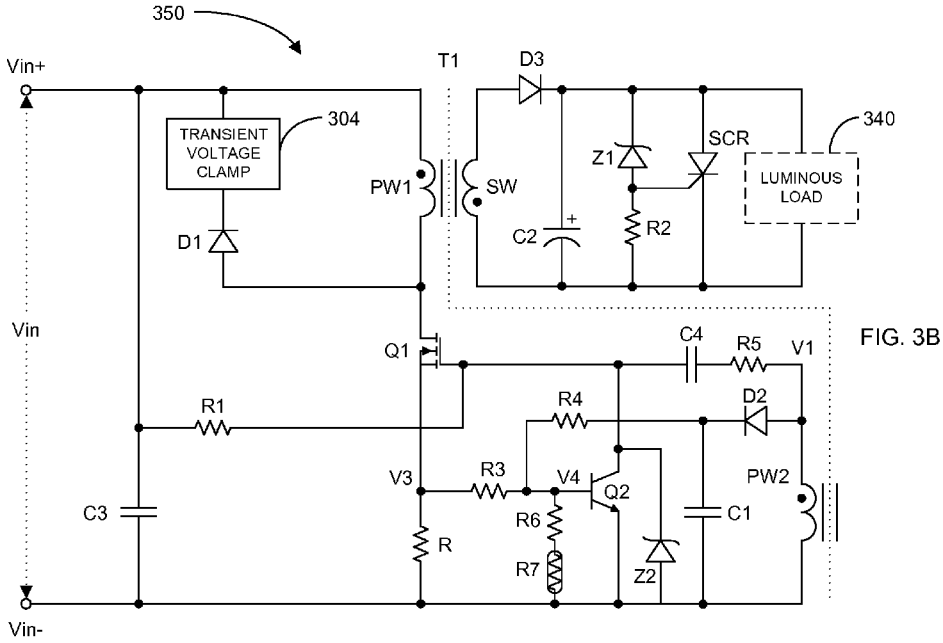

FIG. 3B illustrates a schematic diagram of an exemplary apparatus 350 for supplying substantially constant power to a luminous load 340 in accordance with another embodiment of the invention. The apparatus 350 may be a more detailed implementation of the apparatus 300 previously discussed. Elements in apparatus 350 that perform similar operations as elements in apparatus 300 are identified with the same reference numbers and labels.

More specifically, the apparatus 350 comprises the transient voltage clamp 304 and first diode D1 to clamp leakage energy from the first primary winding PW1 of the transformer T1 to prevent excessive voltage present to the MOSFET Q1 when it is turned OFF. The capacitor C3 and resistor R1, in combination, operate similar to the starting circuit 302, discussed above, to turn ON the MOSFET Q1 upon start-up. That is, upon start-up, the voltage across the capacitor C3 begins to rise. The voltage across the capacitor C3 is coupled to the gate of the MOSFET Q1 via the resistor R1. Once the voltage crosses the threshold of MOSFET Q1, the device turns ON allowing a current to flow through the primary winding PW1 of the transformer T1. The resistor R operates to generate a voltage V3 that is related to the current flowing through the primary winding PW1 of the transformer T1.

The second diode D2 and capacitor C1 operate to sample and hold the voltage V1, which is related to the input voltage Vin. The resistors R3 and R4 operate as the voltage divider 312 and summing node 320 to scale the voltage V2 with reference to the voltage V3 to generate the voltage V4. The thermistor R7 in conjunction with the base-emitter voltage Vbe of the bipolar-junction transistor (BJT) Q2 operate as the temperature-compensated voltage reference 322 discussed above. The BJT Q2 in conjunction with the second Zener diode Z2, capacitor C4 and resistor R5 operate as the AND-gate 314 and driver 316 discussed above.

The third diode D3 operate to rectify the alternating voltage received from the secondary winding SW of the transformer T1. The second capacitor C2 operate to DC filter the rectified voltage to generate the output voltage for the luminous load 340. The first Zener Z1 in conjunction with resistor R2 and silicon-controlled rectifier (SCR) operate as the output voltage clamp 340 discussed above to protect the luminous load 340 from harmful voltage levels.

Figure 4A:
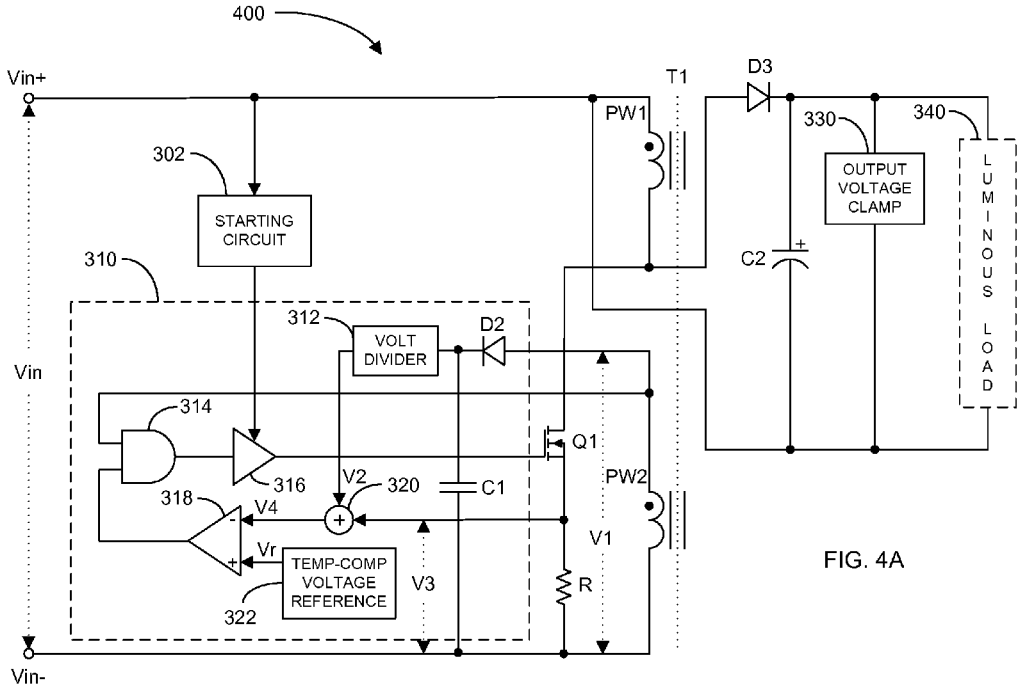
FIGS. 4A-4B respectively illustrate schematic diagrams of other exemplary apparatuses for supplying substantially constant power to a luminous load in accordance with other embodiments of the invention.

FIG. 4A illustrates a schematic diagram of another exemplary apparatus 400 for supplying substantially constant power to a luminous load 340 in accordance with another embodiment of the invention. The apparatus 400 is similar to apparatus 300 and includes many of the same elements as denoted with the same reference numbers and labels. Accordingly, the operation of these common elements have been discussed in detail above. The apparatus 400 differs from apparatus 300 in that the load interface circuit is coupled across the first primary winding PW1 of the transformer T1, instead of the secondary winding SW as in the apparatus 300.

It shall be understood that the load interface circuit may be coupled to the transformer T1 in many distinct manners.

Figure 4B:
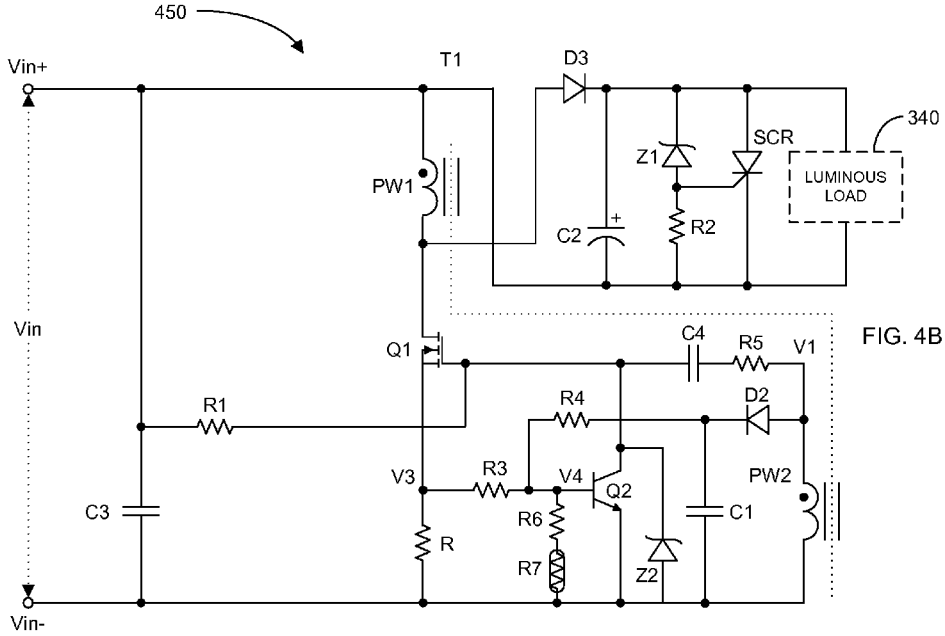

FIG. 4B illustrates a schematic diagram of another exemplary apparatus 450 for supplying substantially constant power to a luminous load 340 in accordance with another embodiment of the invention. The apparatus 450 is similar to apparatus 350 and includes many of the same elements as denoted with the same reference numbers and labels. Accordingly, the operation of these common elements have been discussed in detail above. The apparatus 450 differs from apparatus 350 in that the load interface circuit is coupled across the first primary winding PW1 of the transformer T1, instead of the secondary winding SW as in the apparatus 350. It shall be understood that the load interface circuit may be coupled to the transformer T1 in many distinct manners.

Figure 5A:
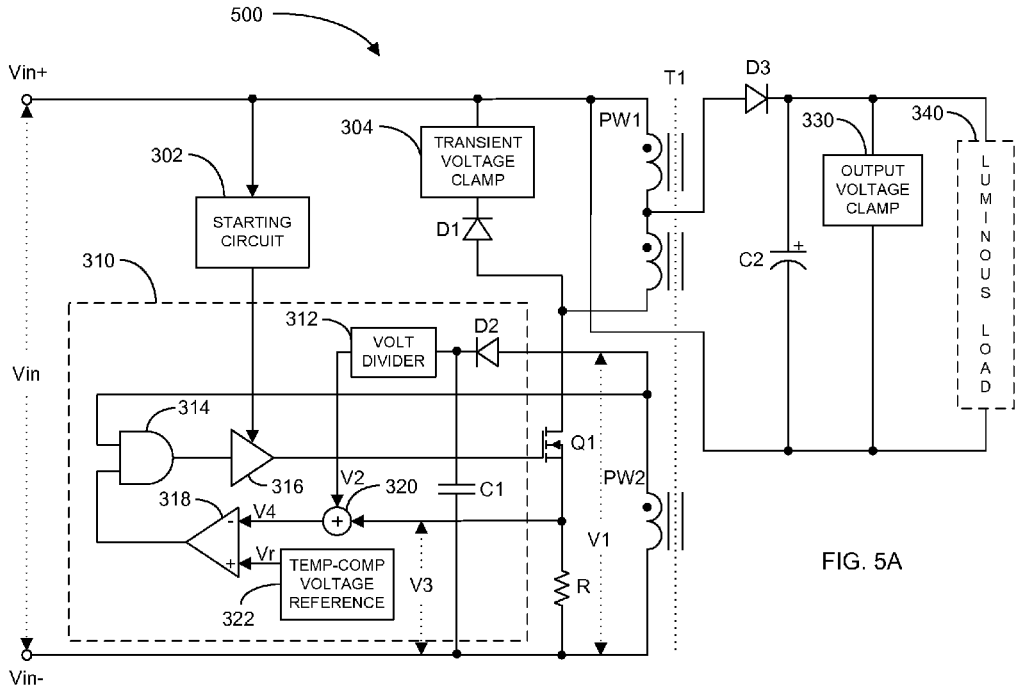
FIGS. 5A-5B respectively illustrate schematic diagrams of other exemplary apparatuses for supplying substantially constant power to a luminous load in accordance with other embodiments of the invention.

FIG. 5A illustrates a schematic diagram of another exemplary apparatus 500 for supplying substantially constant power to a luminous load 340 in accordance with another embodiment of the invention. The apparatus 500 is similar to apparatus 400, and includes many of the same elements as denoted with the same reference numbers and labels. Accordingly, the operation of these common elements have been discussed in detail above. The apparatus 500 differs from apparatus 400 in that the load interface circuit is coupled partially across the first primary winding PW1 of the transformer T1, instead of entirely across the first primary winding PW1 as in the apparatus 400. This may be done so that the output voltage across the load 340 may be a portion or ratio of the voltage across the entire primary winding PW1. It shall be understood that the load interface circuit may be coupled to the transformer T1 in many distinct manners.

Figure 5B:
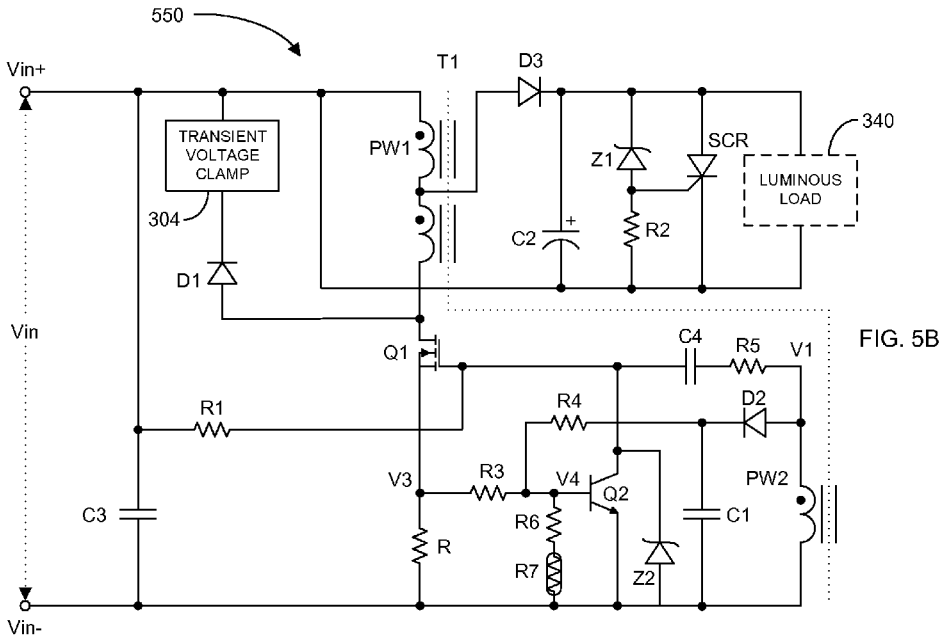

FIG. 5B illustrates a schematic diagram of another exemplary apparatus 550 for supplying substantially constant power to a luminous load 340 in accordance with another embodiment of the invention. The apparatus 550 is similar to apparatus 450 and includes many of the same elements as denoted with the same reference numbers and labels. Accordingly, the operation of these common elements have been discussed in detail above. The apparatus 550 differs from apparatus 450 in that the load interface circuit is coupled partially across the first primary winding PW1 of the transformer T1, instead of entirely across the first primary winding PW1 as in the apparatus 450. This may be done so that the output voltage across the load 340 may be a portion or ratio of the voltage across the entire primary winding PW1. It shall be understood that the load interface circuit may be coupled to the transformer T1 in many distinct manners.

Figure 6A:
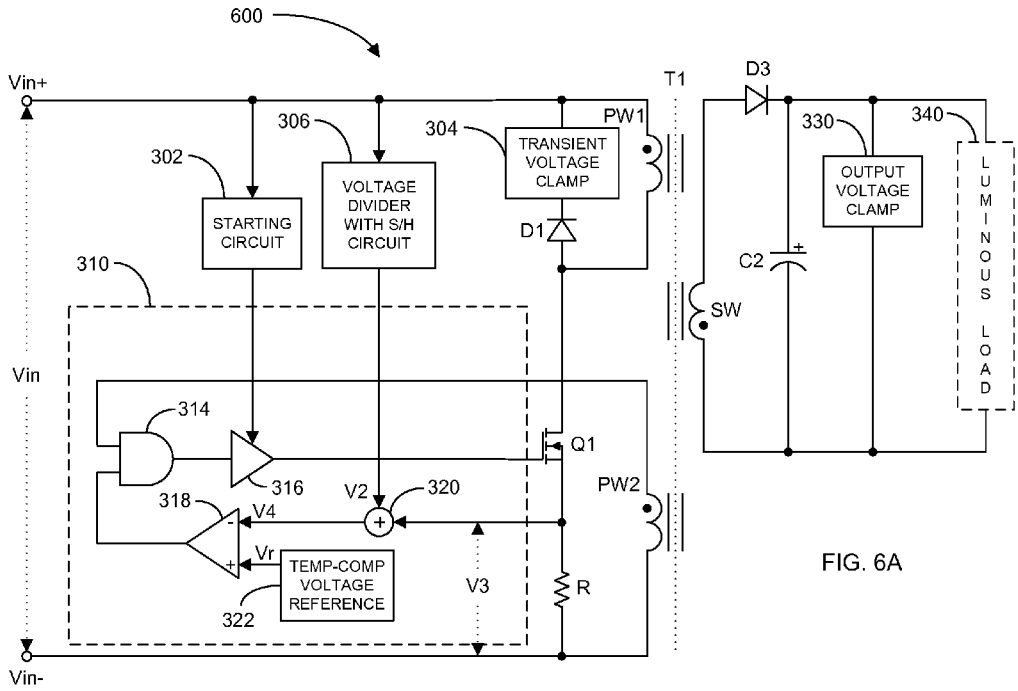
FIGS. 6A-6B respectively illustrate schematic diagrams of other exemplary apparatuses for supplying substantially constant power to a luminous load in accordance with other embodiments of the invention.

FIG. 6A illustrates a schematic diagram of another exemplary apparatus 600 for supplying substantially constant power to a luminous load 340 in accordance with other embodiments of the invention. The apparatus 600 is similar to apparatus 300, and includes many of the same elements as denoted with the same reference numbers and labels. Accordingly, the operation of these common elements have been discussed in detail above. The apparatus 600 differs from apparatus 300 in that the voltage V2 is derived directly from the input voltage line Vin, instead of via the second primary winding PW2 as in apparatus 300. Thus, instead of the diode D2, capacitor C1, and voltage divider 312 of apparatus 300, the apparatus 600 includes a voltage divider with sample and hold (S/H) circuit 306 coupled between the positive input voltage terminal Vin+ and the summing node 320. Accordingly, the circuit 306 produces the voltage V2 which is related to or derived from the input voltage Vin. It shall be understood that the input voltage detection may be performed in many distinct manners.

Figure 6B:
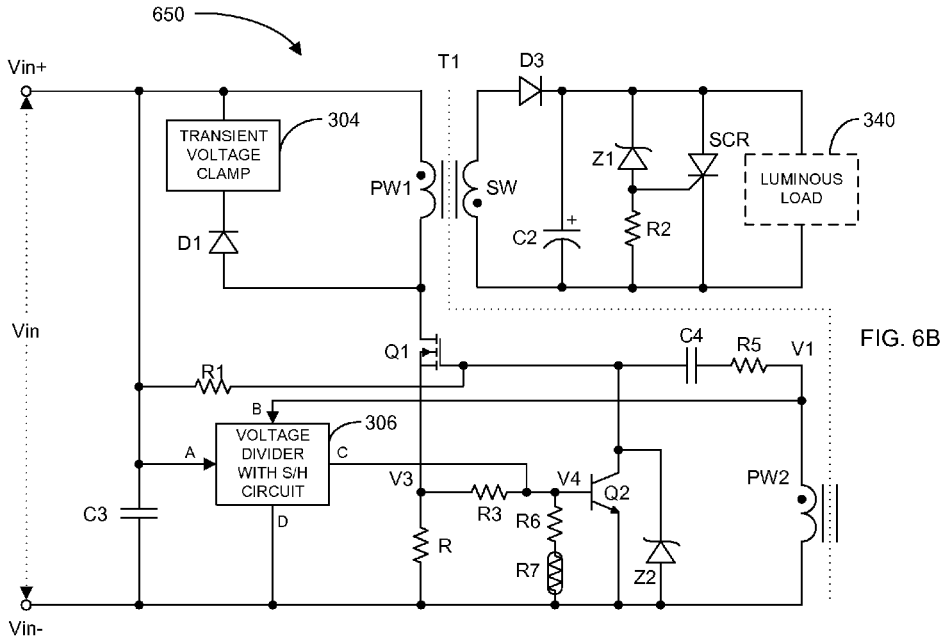

FIG. 6B illustrates a schematic diagram of another exemplary apparatus 650 for supplying substantially constant power to a luminous load 340 in accordance with other embodiments of the invention. The apparatus 650 is similar to apparatus 350, and includes many of the same elements as denoted with the same reference numbers and labels. Accordingly, the operation of these common elements have been discussed in detail above. The apparatus 650 differs from apparatus 350 in that the voltage used for generating V4 is derived directly from the input voltage line Vin. Thus, instead of the diode D2, capacitor C1, and resistor R4 of apparatus 350, the apparatus 650 includes a voltage divider with sample and hold (S/H) circuit 306 having a pair of inputs A and B adapted to receive the voltage Vin+ and V1, an output C adapted to coupled to the base of the BJT Q2, and a terminal D for coupling to Vin−. Accordingly, the circuit 306 assists in producing the voltage V4, which is both related to or derived from the input voltage Vin and the current through the first primary winding PW1 of the transformer T1.

Figure 7A:
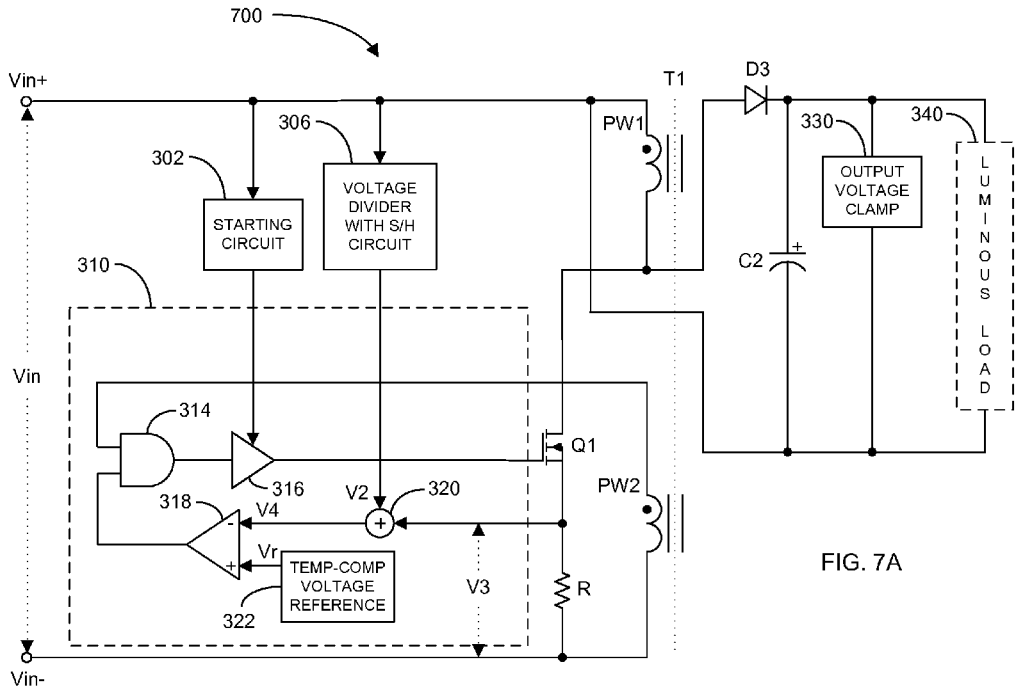
FIGS. 7A-7B respectively illustrate schematic diagrams of other exemplary apparatuses for supplying substantially constant power to a luminous load in accordance with other embodiments of the invention.

FIG. 7A illustrates a schematic diagram of another exemplary apparatus 700 for supplying substantially constant power to a luminous load 340 in accordance with another embodiment of the invention. The apparatus 700 is similar to apparatus 600 and includes many of the same elements as denoted with the same reference numbers and labels. Accordingly, the operation of these common elements have been discussed in detail above. The apparatus 700 differs from apparatus 600 in that the load interface circuit is coupled across the first primary winding PW1 of the transformer T1, instead of the secondary winding SW as in the apparatus 600. It shall be understood that the load interface circuit may be coupled to the transformer T1 in many distinct manners.

Figure 7B:
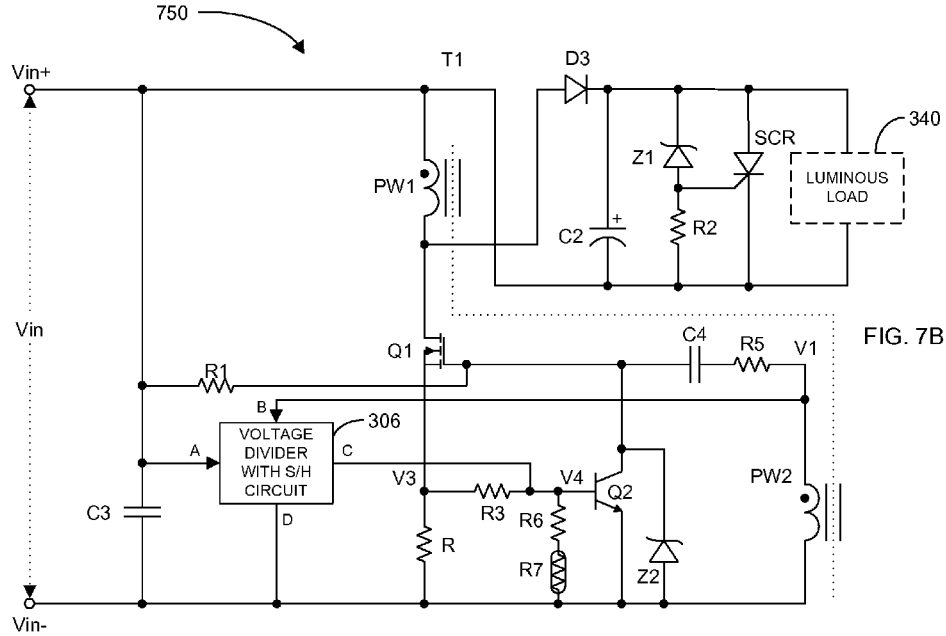

FIG. 7B illustrates a schematic diagram of another exemplary apparatus 750 for supplying substantially constant power to a luminous load 340 in accordance with another embodiment of the invention. The apparatus 750 is similar to apparatus 650 and includes many of the same elements as denoted with the same reference numbers and labels. Accordingly, the operation of these common elements have been discussed in detail above. The apparatus 750 differs from apparatus 650 in that the load interface circuit is coupled across the first primary winding PW1 of the transformer T1, instead of the secondary winding SW as in the apparatus 350. It shall be understood that the load interface circuit may be coupled to the transformer T1 in many distinct manners.

Figure 8A:
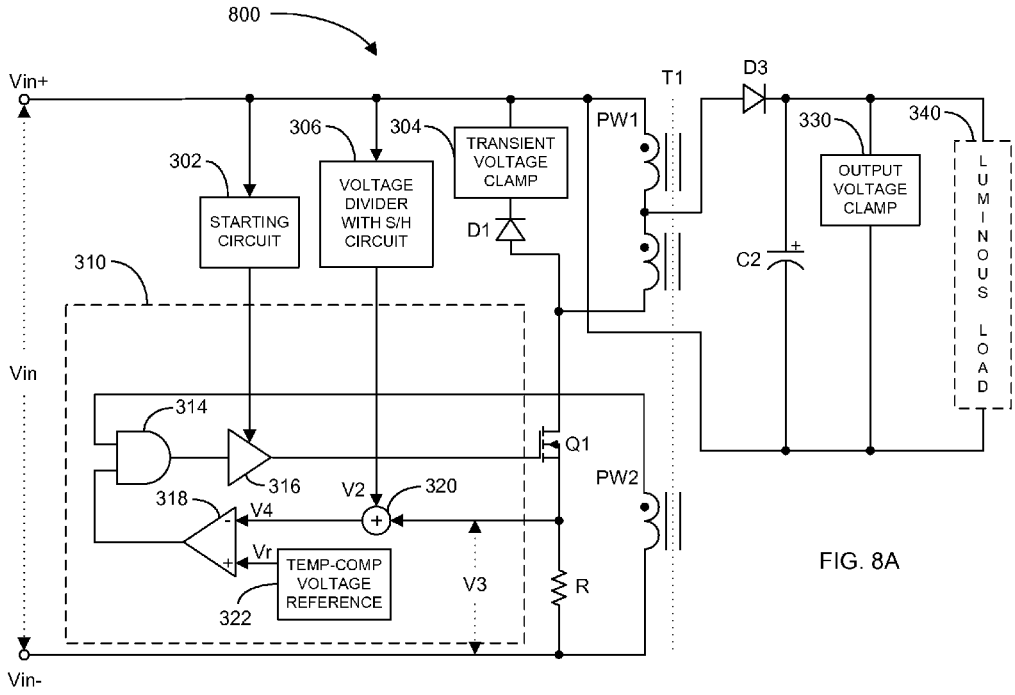
FIGS. 8A-8B respectively illustrate schematic diagrams of other exemplary apparatuses for supplying substantially constant power to a luminous load in accordance with other embodiments of the invention.

FIG. 8A illustrates a schematic diagram of another exemplary apparatus 800 for supplying substantially constant power to a luminous load 340 in accordance with another embodiment of the invention. The apparatus 800 is similar to apparatus 700, and includes many of the same elements as denoted with the same reference numbers and labels. Accordingly, the operation of these common elements have been discussed in detail above. The apparatus 800 differs from apparatus 700 in that the load interface circuit is coupled partially across the first primary winding PW1 of the transformer T1, instead of entirely across the first primary winding PW1 as in the apparatus 700. This may be done so that the output voltage across the load 340 may be a portion or ratio of the voltage across the entire primary winding PW1. It shall be understood that the load interface circuit may be coupled to the transformer T1 in many distinct manners.

Figure 8B:
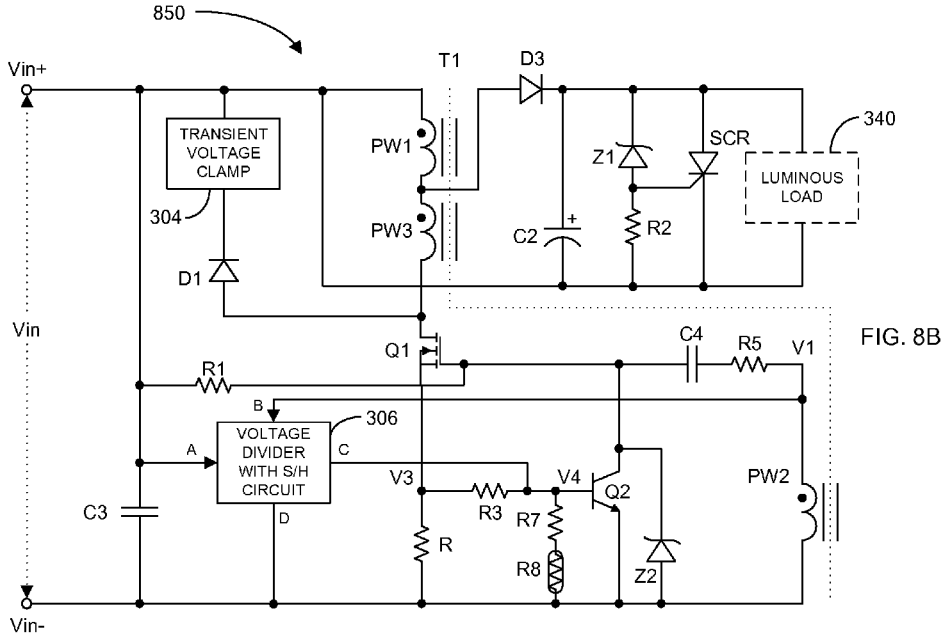

FIG. 8B illustrates a schematic diagram of another exemplary apparatus 850 for supplying substantially constant power to a luminous load 340 in accordance with another embodiment of the invention. The apparatus 850 is similar to apparatus 750 and includes many of the same elements as denoted with the same reference numbers and labels. Accordingly, the operation of these common elements have been discussed in detail above. The apparatus 850 differs from apparatus 750 in that the load interface circuit is coupled partially across the first primary winding PW1 of the transformer T1, instead of entirely across the first primary winding PW1 as in the apparatus 750. This may be done so that the output voltage across the load 340 may be a portion or ratio of the voltage across the entire primary winding PW1. It shall be understood that the load interface circuit may be coupled to the transformer T1 in many distinct manners.

Figure 9:
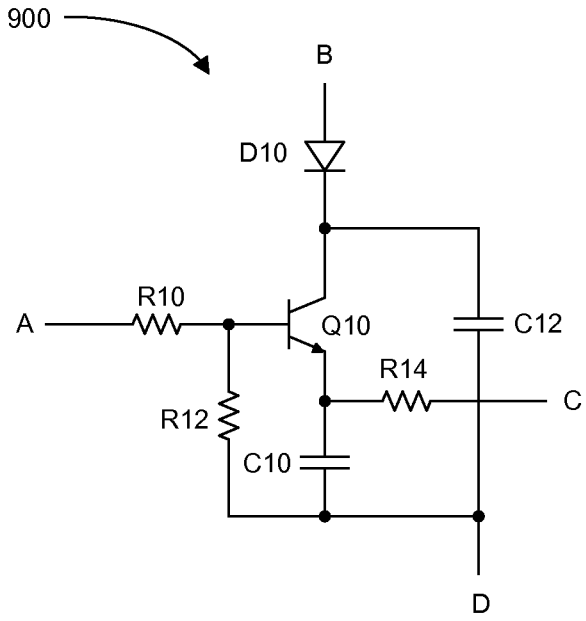
FIG. 9 illustrates a schematic diagram of an exemplary voltage divider with sample and hold (S/H) circuit in accordance with another embodiment of the invention.

FIG. 9 illustrates a schematic diagram of an exemplary voltage divider with sample and hold (S/H) circuit 900 in accordance with another embodiment of the invention. The voltage divider and S/H circuit 900 may be one detailed implementation, among others, of the circuit 306 previously discussed. The circuit 900 comprises a diode D10, resistors R10, R12, and R14, capacitors C10 and C12, and BJT Q10. The resistor R10 is coupled between node A (which is adapted to receive Vin+ as previously discussed) and the base of BJT Q10. The diode D10 is coupled in the forward junction direction between node B (which is adapted to receive voltage V1 as previously discussed) and the collector of the BJT Q10. The resistor R12 is coupled between the base of the BJT Q10 and node D (which is coupled to Vin− as previously discussed). The capacitor C10 is coupled between the emitter of BJT Q10 and node D. The capacitor C12 is coupled between the collector of BJT Q10 and node D. The resistor R14 is coupled between the emitter of the BJT Q10 and node C (which is coupled to the base of BJT Q2 previously discussed).

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An apparatus for supplying power to a luminous load, comprising:

a transformer including a first primary winding configured to receive an input voltage; and a control circuit configured to generate an alternating current through the first primary winding based on a first signal derived from the input voltage and a second signal derived from the current, wherein the transformer is configured to develop an alternating voltage across the first primary winding based on the alternating current, wherein the control circuit comprises a summing node configured to generate a third signal from the first and second signals, and wherein the control circuit is configured to generate the alternating current based on the third signal and a temperature-compensated reference signal; and a load interface circuit configured to generate an output voltage for the luminous load based on the alternating voltage from the transformer.

2. The apparatus of claim 1, wherein the control circuit is configured to generate the alternating current to deliver substantially constant power to the luminous load in response to variation in the input voltage.

3. The apparatus of claim 1, wherein the control circuit is configured to generate the alternating current to deliver substantially constant power to the luminous load in response to variation in an environment temperature.

4. The apparatus of claim 1, wherein the control circuit is configured to vary the power supplied to the luminous load in response to changes in the input voltage caused by a dimmer circuit.

5. The apparatus of claim 1, wherein the first signal varies only as a function of a peak amplitude of the input voltage.

6. The apparatus of claim 1, wherein the control circuit further comprises:

a source of the temperature-compensated reference signal; and a comparator configured to generate a fourth signal based on a comparison of the temperature-compensated reference signal and the third signal;

wherein the control circuit is configured to generate the alternating current based on the fourth signal.

7. The apparatus of claim 6, wherein the control circuit further comprises a logic gate device configured to generate a fifth signal based on the fourth signal, wherein the control circuit is configured to generate the alternating current based on the fifth signal.

8. The apparatus of claim 1, wherein the transformer comprises a second primary winding, and wherein the first signal is derived from a voltage across the second primary winding.

9. The apparatus of claim 1, wherein the first signal is derived directly from the input voltage.

10. The apparatus of claim 1, wherein the load interface circuit is configured to receive the alternating voltage directly from at least a portion of the first primary winding.

11. The apparatus of claim 1, wherein the transformer comprises a secondary winding, and wherein the load interface circuit is configured to receive the alternating voltage from at least a portion of the secondary winding.

12. The apparatus of claim 1, wherein the load interface circuit comprises:

a rectifier configured to rectify the alternating voltage; and a capacitive element configured to filter the rectified voltage to generate the output voltage for the luminous load.

13. The apparatus of claim 1, further comprising a transient voltage clamp circuit configured to absorb leakage current from the first primary winding of the transformer.

14. The apparatus of claim 1, wherein the luminous load comprises a light emitting diode (LED)-based load, an incandescent-based load, or a fluorescent-based load.

15. An apparatus for supplying power to a luminous load, comprising:

a transformer including a first primary winding configured to receive an input voltage;

a control circuit configured to generate an alternating current through the first primary winding based on a first signal derived from the input voltage and a second signal derived from the current, wherein the transformer is configured to develop an alternating voltage across the first primary winding based on the alternating current; and a load interface circuit configured to generate an output voltage for the luminous load based on the alternating voltage from the transformer, wherein the load interface circuit comprises:

a rectifier configured to rectify the alternating voltage;

a capacitive element configured to filter the rectified voltage to generate the output voltage for the luminous load; and an output clamp circuit configured to at least partially shunt the luminous load if the output voltage exceeds a defined threshold.

16. A method for supplying power to a luminous load, comprising:

generating an alternating current through a primary winding of a transformer based on a third signal generated at a summing node that receives a first signal derived from an input voltage, a second signal derived from the current, and a temperature-compensated reference signal;

generating an alternating voltage across the primary winding of the transformer in response to the alternating current; and generating an output voltage for the luminous load based on the alternating voltage from the transformer.

17. The method of claim 16, wherein generating the alternating current comprises generating the alternating current in a manner that substantially constant power is delivered to the luminous load in response to variation in the input voltage or environment temperature.

18. The method of claim 16, wherein generating the alternating current comprises generating the alternating current in a manner that varies the power supplied to the luminous load in response to changes in the input voltage caused by a dimmer circuit.

19. An apparatus for controlling power to a luminous load, comprising a control circuit configured to generate an alternating current through a first primary winding of a transformer based on a drive signal, wherein a duty cycle of the drive signal is modulated by a first signal derived from an input voltage, a second signal derived from the current, and a temperature-compensated reference signal, and wherein the transformer is configured to deliver power to the luminous load based on the alternating current.

20. The apparatus of claim 19, wherein the control circuit is configured to generate the alternating current to deliver substantially constant power to the luminous load in response to variation in the input voltage or an environment temperature.

21. The apparatus of claim 19, wherein the control circuit is configured to vary the power supplied to the luminous load in response to changes in the input voltage caused by a dimmer circuit.

* * * * *